US006231670B1

(12) United States Patent
Fischer et al.

(10) Patent No.: US 6,231,670 B1
(45) Date of Patent: May 15, 2001

(54) APPARATUS FOR IMPREGNATING AND COATING PAPER

(75) Inventors: Siegfried Fischer, deceased, late of Bad Hersfeld, by Fennie Fischer, Peter Fischer, Marina Fischer, legal representatives; Willi Erkelenz, Langenfeld; Ernst Klas, Siegburg; Gisbert Krossa, Wülfrath; Udo Unger, Leichlingen, all of (DE)

(73) Assignee: Vits Maschinenbau GmbH, Langenfeld (DE)

( * ) Notice: Subject to any disclaimer, the term of this patent is extended or adjusted under 35 U.S.C. 154(b) by 0 days.

(21) Appl. No.: 09/483,477

(22) Filed: Jan. 14, 2000

(30) Foreign Application Priority Data

Jan. 16, 1999 (DE) ..... 199 01 525

(51) Int. Cl.[7] ..... B05C 1/08

(52) U.S. Cl. ..... 118/67; 118/68; 118/221; 118/224; 118/249; 118/261

(58) Field of Search ..... 118/217, 221, 118/223, 224, 249, 261, 419, 67, 68; 427/203, 207.1, 208, 209, 211, 411, 428, 439, 440; 156/578

(56) References Cited

U.S. PATENT DOCUMENTS

| | | | | |
|---|---|---|---|---|
| 3,034,926 | * | 5/1962 | Carter et al. | 118/67 |
| 3,121,642 | * | 2/1964 | Biskup | 427/203 |
| 4,782,753 | * | 11/1988 | Bolza-Schunemann | 101/363 |
| 5,168,806 | * | 12/1992 | Reder et al. | 118/261 |
| 5,788,792 | * | 8/1998 | Lee | 427/207.1 |
| 6,054,177 | * | 4/2000 | Endoh et al. | 427/203 |
| 6,060,124 | * | 5/2000 | Ikegawa et al. | 427/379 |

FOREIGN PATENT DOCUMENTS

| | | |
|---|---|---|
| 432 818 | 3/1965 | (CH) . |
| 36 109 43 | 7/1987 | (DE) . |
| 195 08 797 | 8/1996 | (DE) . |
| 198 14 212 | 9/1999 | (DE) . |
| 198 25 156 | 10/1999 | (DE) . |

* cited by examiner

*Primary Examiner*—Laura Edwards
(74) *Attorney, Agent, or Firm*—Jerbert Dubno

(57) ABSTRACT

A paper web impregnated with a liquid resin and following impregnation is coated with an abrasive particle containing coating mass or composition and then dried before a liquid resin is applied which does not contain the abrasive particles. The web is then finally dried and the resulting paper is particularly suitable as a cover sheet in the hot pressing of laminates since it minimizes wear of the laminate press.

6 Claims, 3 Drawing Sheets

APPARATUS FOR IMPREGNATING AND COATING PAPER

FIELD OF THE INVENTION

Our present invention relates to a method of and to an apparatus for the impregnation and coating of paper webs and, more particularly, the impregnation and coating of paper which can be used as a cover sheet for a wear-resistant laminate.

In particular, the method and apparatus of the invention produce a cover sheet for laminates, for example, pressed board or laminates of a plurality of layers of paper or cellulosic materials, utilizing a paper web which is displaced along a continuous path and is usually impregnated with a resin (i.e. a synthetic resin) and then is coated on one side with a coating mass or composition comprised of a liquid resin, usually a synthetic resin, and fine grained abrasive material, especially corundum, before the paper web is dried.

BACKGROUND OF THE INVENTION

Swiss Patent 432,818 describes a process and apparatus for the coating of paper webs which impregnates a continuous paper web by passing it through a resin bath. The excess of the impregnating resin is then pressed out of the web in the nip between a pair of squeezing rolls. The coating mass or composition is then applied by a nozzle tube onto one surface, usually an upper surface, of the freshly impregnated still-wet paper web and is smoothed with a doctor strip. The so impregnated and coated paper web can then be carried through a dryer on a transport belt, cut into sheets and laminated as the cover sheet on a stack in a hot press.

In a similar process described in German Patent 195 08 797 C1, the upper web impregnated with the resin is dried to a predetermined original moisture content before it is coated with the composition on one side. After such coating the paper web is dried to a final moisture content. The resulting decorative paper is pressed to a laminate by applying it to a board of a wood composition.

The coating composition or mass may include a resin component which, by comparison with the melamine resin commonly used for lamination, has a significantly higher viscosity and is applied in a relatively thick layer in which the particles of hard material like corundum, can be uniformly distributed. One of the advantages of this process and especially the homogeneous distribution of the hard-material particles is that a smooth surface can be formed which is not interrupted by projecting hard material particles embedded in the composition and from which the hard material particles do not ablate.

This latter patent also notes that hard material particles which may emerge from the surface can cause increased wear of the tools used in processing the laminated products and, in particular, the press parts when hot pressing is used. Nevertheless press wear remains a significant problem when the coating mass or composition contacts the press parts and the earlier process is practiced.

OBJECTS OF THE INVENTION

It is, therefore, the principal object of the present invention to provide a method of the type described wherein further processing of the coating paper, especially hot pressing, does not lead to rapid wear of the parts or tools of the processing machinery.

Another object of the invention is to provide an improved method of producing paper for use as cover sheets in lamination which can improve laminating economies and provide high quality wear resistant laminated products.

It is also an object of the invention to provide an improved method of and apparatus for the impregnation and coating of paper webs whereby drawbacks of earlier systems are avoided.

SUMMARY OF THE INVENTION

These objects and others which will become apparent hereinafter are attained, in accordance with the invention in a method of impregnating and coating of paper for use as a cover sheet in a wear-resistant laminate which comprises the steps of:

(a) impregnating a paper web with a synthetic resin;

(b) thereafter applying a coating composition containing a liquid resin and a fine-grain abrasive material to one side of the paper web impregnated with the synthetic resin to produce a coated paper;

(c) thereafter drying the coated paper to form an abrasive layer on the coated paper;

(d) applying over the abrasive layer on the coated paper a coating of a liquid resin free from abrasive particles; and (e) drying the coating on the coated paper web.

The liquid resin can, in particular, be applied in an amount of 10 to 80 g/m$^2$ and preferably the liquid resin is applied in this amount to both sides of the paper web, i.e. to the side provided with the abrasive layer and to the opposite side of this web. Advantageously, the web is dried in step (c) to a residual moisture content of 8 to 17% and in step (e) to a residual moisture content of 4 to 9%.

The apparatus for carrying out the method can comprise:

means for forming a path for a paper web;

impregnating means along the path for impregnating the paper web with a synthetic resin;

a first coater along the path downstream of the impregnating means for thereafter applying a coating composition containing a liquid resin and a fine-grain abrasive material to one side of the paper web impregnated with the synthetic resin to produce a coated paper;

a dryer along the path downstream of the first coater for thereafter drying the coated paper to form an abrasive layer on the coated paper;

a second coater along the path downstream of the dryer for applying over the abrasive layer on the coated paper a coating of a liquid resin free from abrasive particles; and a further dryer along the path downstream of the second coater for drying the coating on the coated paper web.

The second coater can include a screen-coating roller and preferably the second coater can include:

a deflecting roller around which the paper web is looped;

a metering roller parallel to the deflecting roller and defining a gap therewith at driven at least approximately synchronously with the deflecting roller;

a slot nozzle for applying liquid resin to the web on the deflecting roller directly or to the metering roller; and a doctoring element comprising a rectangular flap of flexible elastomeric material affixed at one side along an edge parallel to the rollers and resting slackly on an upper stretch of the web coming off the deflection roller.

The apparatus can further comprise a retaining bar receiving the edge parallel to the rollers, and a vibrator connected to the bar for vibrating same.

Alternatively, the second coater includes:

a deflecting roller around which the paper web is looped;

a slot nozzle for applying liquid resin to the web on the deflecting roller directly;

a premetering element comprising an elastic strip of limited stiffness and composed of plastic for controlling an amount of liquid resin applied to the web; and an air brush trained on the web on the deflection roller.

An applicator can be provided between the first coater and the further dryer for applying a liquid resin to the opposite side of the paper web between steps (c) and (e). This applicator may also be a screen coating roller and is preferably provided between the second coater and the dryer.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
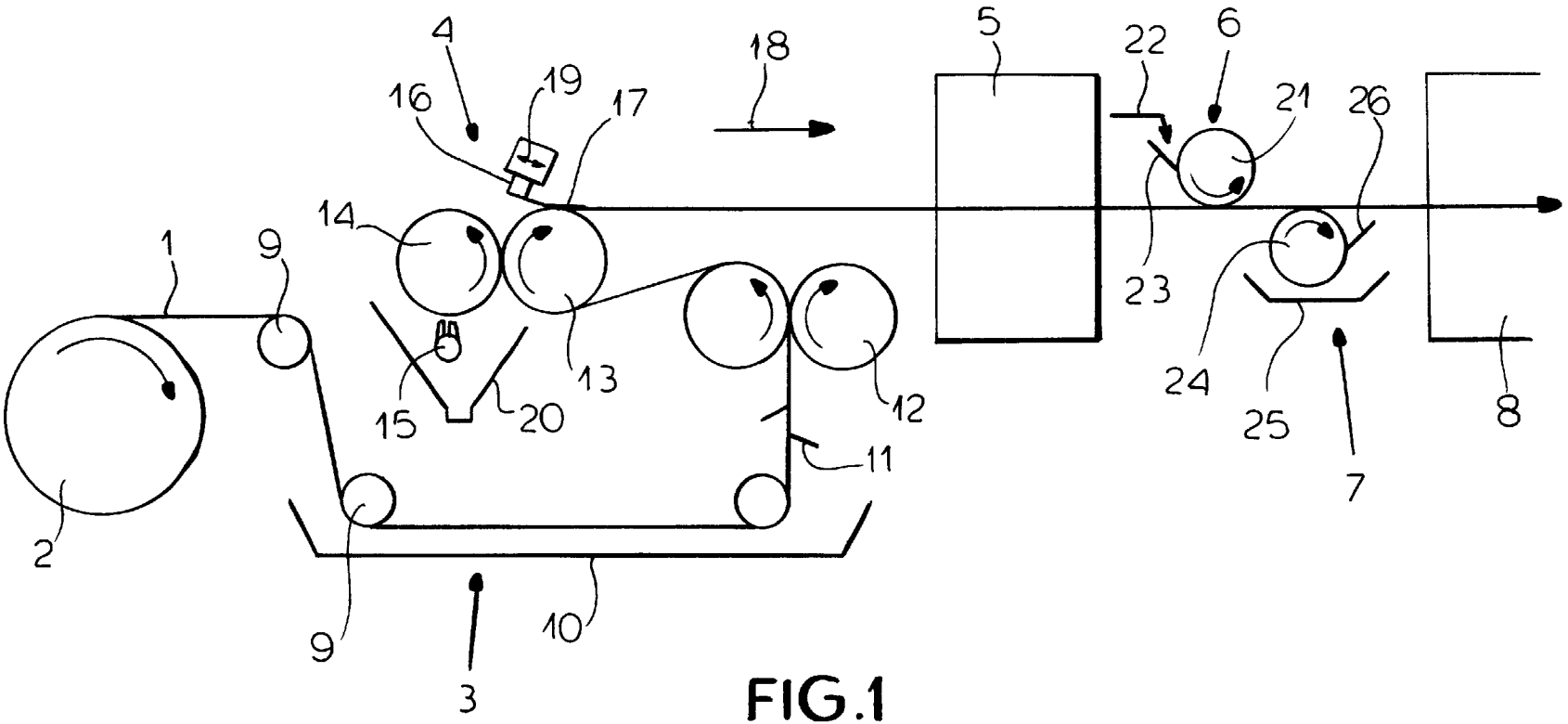
FIG. 1 is a diagram illustrating an apparatus for carrying out the method in a first embodiment of the invention.

The paper web in all three of the figures has been represented at 1 and corresponding units of the apparatus have been designated with the same reference characters in all three figures.

As can be seen from FIG. 1, an apparatus for impregnating and coating a paper web which can be subsequently cut into sheets and hot laminated to boards of wood composition can comprise a roll 2 from which the paper web 1 is unrolled along a transport path which includes an impregnator 3, a first coater 4, an intermediate or first dryer 5, a second coater 6 an applicator 7 and a second or final dryer.

In the impregnating unit 3, the paper web 1 is guided around deflection rollers 9 in a tank 10 containing a liquid impregnating resin, preferably a urea-formaldehyde resin, a melamine resin or a mixture of urea-formaldehyde and melamine resins to impregnate the paper web.

Strippers 11 on opposite sides of the paper web and or squeezing roller pairs 12 can remove excess impregnating resin from the paper web and the weight per unit area of the impregnating resin left in the paper may correspond to the paper weight per unit area of the paper web entering the impregnating device.

From the squeezing roller pair 12, the paper web 1 is guided substantially horizontally to a deflection roller 13 of the coating unit 4, the paper web passing in a loop around the deflection roller 13 through an angular extent in excess of say 180° or more. Adjacent the deflection roller 13 and parallel thereto is a metering roller 14. The latter has the same diameter as the deflection roller 13 and is driven substantially synchronously therewith. The width of the gap between the rollers 13 and 14 is adjustable and the metering roller 14 and the deflection roller 13 can have drives which are mechanically or electrically coupled so that their peripheral speeds are the same, but the directions of rotation are opposite. Beneath the metering roller 14 a slot nozzle 15 applies the coating mass or composition to the metering roller 14. This composition consists of a liquid resin, e.g. a resin which can be the same as the impregnating resin, and a fine grained abrasive material, especially corundum particle.

Above the deflection roller 13 and mounted on the machine frame is a mounting bar 16 extending parallel to the axes of the rollers 13, 14. This mounting bar 16 engages a rear edge of a rectangular flap 17 of flexible elastomeric material extending the full width of the web. The front edge of the flap 17 is free and the flap 17 lies slackly one upon the coated upper pass of the web one substantially at the region at which the paper web leaves the roller 13.

The width of the flap 17 in the direction of travel of the paper web and represented by the arrow 18 can be 5 to 50 centimeters and is preferably between about 10 to 30 centimeters. The flap has a thickness of about 2 to 5 mm.

A vibrator 19 can be connected to the mounting bar 16 (see German Patent Document 19825156.4-2). The vibrator vibrates the bar 16 and the vibrations are transmitted to the flap 17 to improve the smoothing of the coating containing abrasive particles and applied to the web. The flap 17 does not control the metering of this composition onto the web. Rather, the metering is controlled by adjustment of the gap between the deflection roller 13 and the meter roller 14.

A collection funnel 20 is provided beneath the slot nozzle 15 for collecting the excess coating composition.

In a modification of the system of FIG. 1, the slot nozzle 15 can be so arranged that it applies the coating mass to the lower pass of the web loop on the deflecting roller 13, approximately at the line of contact with which the web first meets the deflecting roller 13, or to an upper portion of the metering roller 14.

From the coater 4, the paper web 1, which has a layer of 20 to 150 g/m$^2$ of the coating mass on its upper side, passes substantially horizontally to and through a first dryer 5 which can be equipped with a system of support nozzles so that the web 1 travels contactlessly or on an air cushion through the dryer 5. In this dryer the web is dried to a residual moisture content of 8–17%.

Directly downstream of the first dryer 5, the coater 6, 5 operating with a screen coating roller 21, applies a thin cover layer of liquid resin, e.g. the same resin as applied in the impregnation stage, in an amount of about 10–80g/m$^2$ to the web. A pipe 22 can deliver the liquid resin to a gap between the coating roller 21 and a stripper blade 23. The liquid resin in the coater 6 does not contain any abrasive particles.

The screen coating roller 21 is coupled with a supply and transport system which conveys the paper web and which has been represented only by the supply roller 2 in FIG. 1 so that the peripheral speed of the coating roller 21 will correspond to the transport speed of the paper web and hence between the screen coating roller 21 and the coated paper web 12 is no relative displacement. This prevents premature rubbing and wear on the predried coating containing abrasive particles and the screening coating roller 21.

Directly following the coater 21 is a further screen coating roller 24 of the applicator 7 which has a supply tank 25 from which the liquid resin is picked up by the applicator roller 24 and applied to the underside of the web 1. The liquid resin can be delivered to the gap between a stripper 26 and the screen coating roller 24. An important advantage of the screen coating rollers 21, 24 is that the metering of the resin to be coated onto the paper web can be applied directly to the screen roller and transferred to the paper web without any special metering unit.

Another important advantage is that a deflection of the paper web is not required.

The arrangement of the two screen rollers 21, 24 corresponds substantially to that in German Patent DE 36 10 943 C1. Here the liquid resin is applied between two spaced apart locations without supporting the paper web on the other side and in a substantially straight line travel of the web. The resin layer applied to the underside serves to bond the decorative paper to a substrate, for example, a wood board, preferably by hot pressing. Often it also serves to avoid bulging of the paper web in the transverse direction.

Downstream of the coater 7, the paper web passes through the second and final dryer 8 in which it is also guided contactlessly and is finish dried to a final moisture content of 4to 9%.

Figure 2:
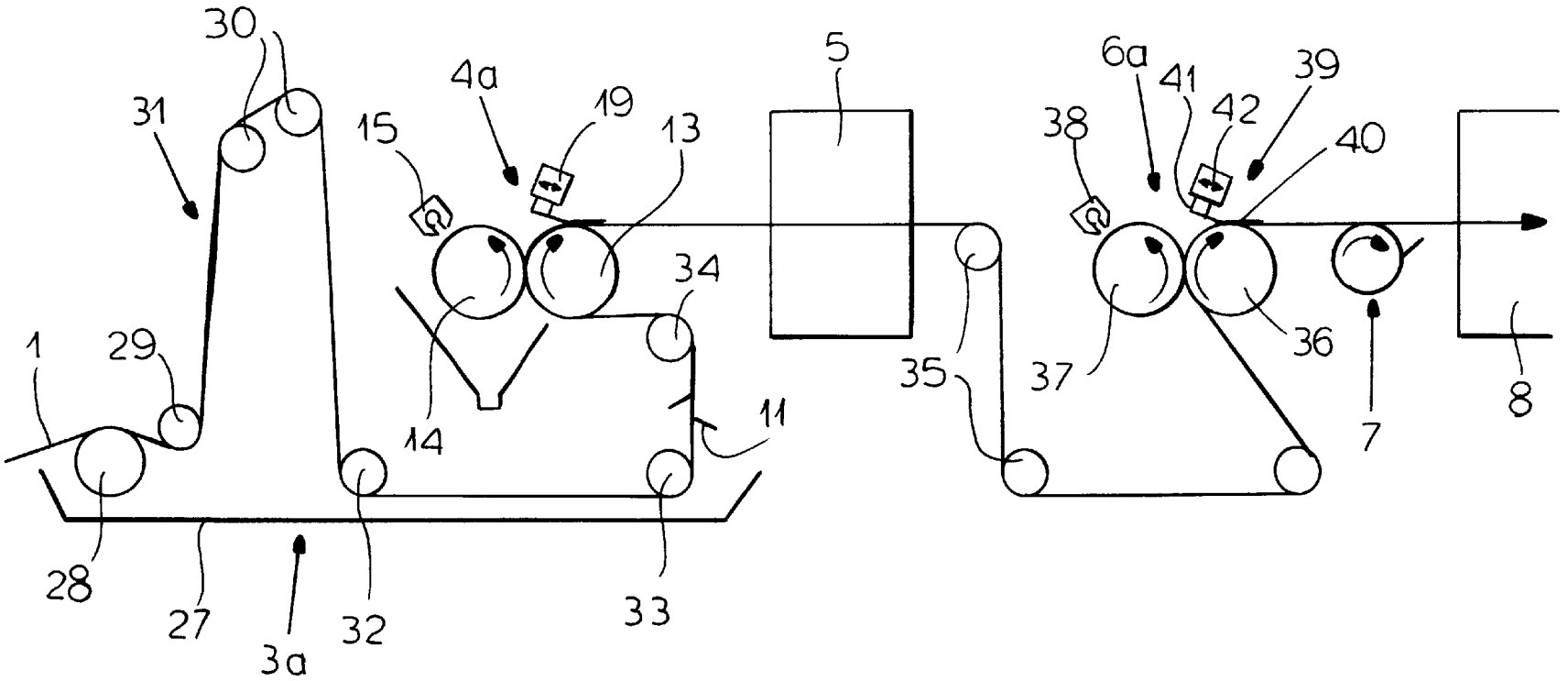
FIG. 2 is a diagram of an apparatus for carrying out the method in accordance with a second embodiment of the invention.

The apparatus of FIG. 2 is generally similar but has a different type of impregnating unit 3. A tray-shaped tank filled with the liquid impregnating reserve is provided at 27 with an applicator 28 on the inlet side and has a portion of its periphery immersed in the impregnating agent bath. The paper web is guided over the applicator roller 28 so that it lies on the periphery of this roller and meets it at an acute angle. Impregnating agent which adheres to the surface of the applicator roller 28 is thereby transferred to the underside of the paper web 1. The paper web then travels over a short portion of its path to a roller 29 spaced close to the roller 28 and then over roller 30 which can be disposed approximately one meter above the tray to form a substantially vertical loop 31. The paper web 1 is then guided beneath the rollers 32 and 33, spaced apart by a distance of 0.5 to 2 mm, through the bath where the paper web is saturated by additional impregnating resin. The so soaked paper web 1 has superfluous impregnating resin removed by strippers 11 before passing over a roller 34 of the first coater 4*a*.

The first coater differs from the coater 4 described in connection with FIG. 1 only in that the slot nozzle 15 is juxtaposed with the upper portion of the metering roller 14 at an angle to the vertical/horizontal so that the corundum containing coating mass is applied to an upper portion of the roller 14. From the coater 4*a*, the paper web passes through the first dryer 5 and then via the deflecting roller 35, to the second coater 6*a*.

The second coater corresponds in construction and operation to the first coater 4*a* and has a deflecting roller 36 around which the paper web, a metering roller 37 parallel to the deflecting roller 36 and forming a narrow adjustable gap therewith and synchronously or approximately synchronously driven therewith, and a slot nozzle 38 for applying the liquid resin to the metering roller 37. A doctor arrangement 39 comprised of a rectangular flap 40 of flexible elastomeric material rests upon the web and has a rear edge anchored in a mounted bar 41 parallel to the axis of the roller 36, 37.

The flap 40 rests slackly when the upper paths of the loop just where the loop leaves the roller 36. The mounting bar 41 can be vibrated by the vibrator 32.

Figure 3:
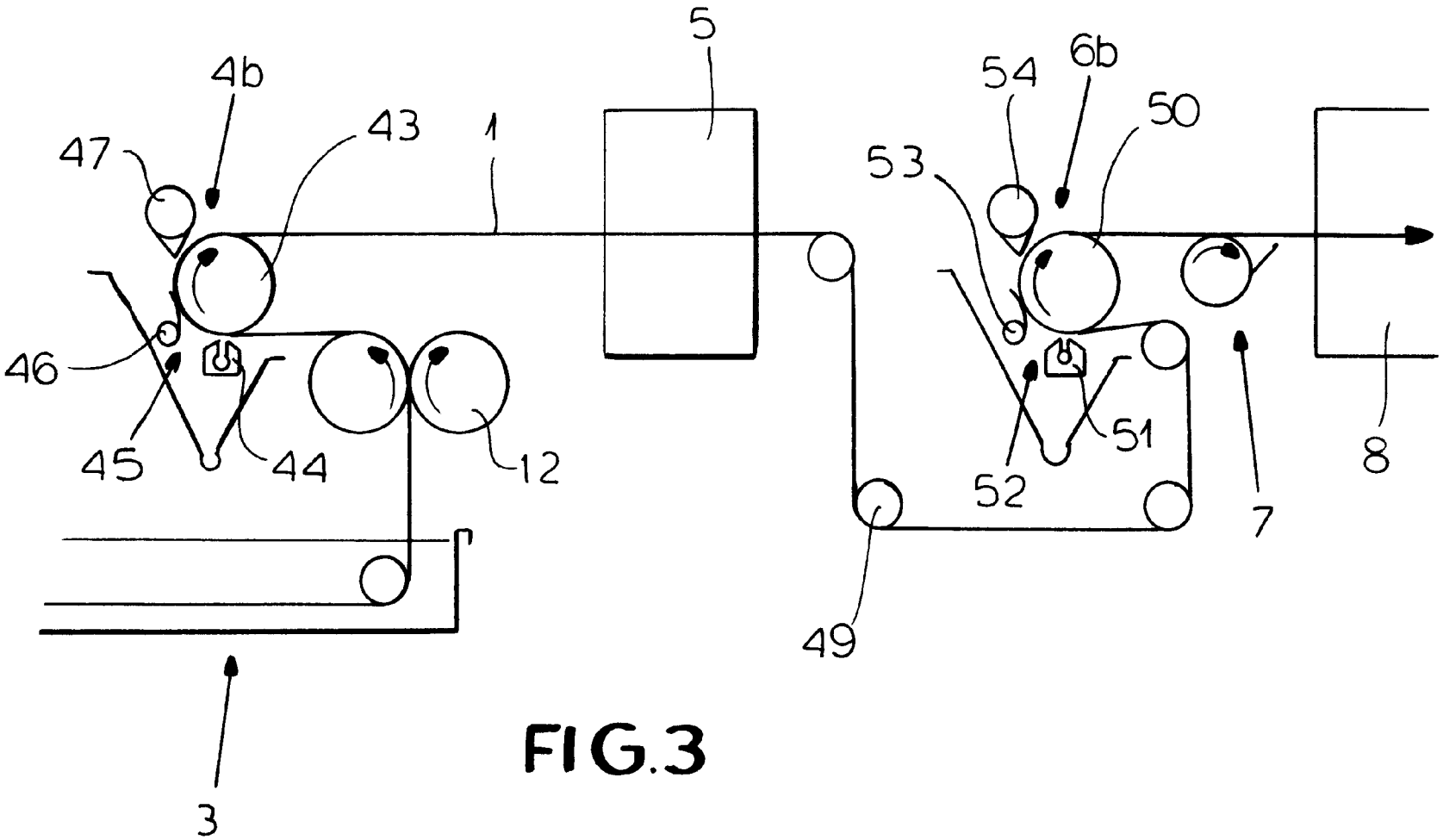
FIG. 3 is a diagram of an apparatus for carrying out the method in accordance with a third embodiment of the invention.

Directly following the coater 6*a* is an applicator 7 as in the embodiment of FIG. 1, applying liquid resin to the underside of the paper web before it enters the final dryer 8. The slot nozzle 38 can also be juxtaposed with the deflecting roller 36 below the ladder approximately in the region where the web first encounters that deflecting roller so that the liquid resin can be applied directly to the paper web in a manner similar to that as represented in FIG. 3 by the coater 6*b*. In the embodiment of FIG. 3, the impregnator 3 is shown only in part since it corresponds to that of FIG. 1 except that the strippers 11 have not been shown in FIG. 3. From the squeezing roller pair 12 of the impregnator the paper web 1 travels in a substantially horizontal direction to a deflection roller 43 of the first coater 4*b*. The paper web is looped about the deflection roller 43 through about 180°. A slot nozzle applies the abrasive composition from below to the paper web 1, substantially at the line along which the web 1 first meets the roller 2, 3. At substantially the middle of the loop, a predosing unit 45 is provided which has an elastic flat bar 46 of limited bending and preferably of plastic bearing upon the coating. Spaced from this predosing unit 45 in the direction of the line at which the paper web leaves the deflecting roller 43, an air brush 47 is so trained that its jet has both a radial component toward the axis of the roller 43 and the tangential component opposite the direction of travel of the web. The slot nozzle 44 applies the coating mass of liquid resin and abrasive particles in a 5 to 10 fold excess. The weakly elastic but not slack stripper 46 removes the greater portion of this mass so that only a limited portion corresponding to a 2 to 3 fold excess remains on the paper web 1. The force with which the stripper 46 rests upon the paper web is so weak that larger particles in the coating mass do not penetrate into the paper with the danger of tearing. The air brush 47 provides precise metering and smoothing of the coating mass before the paper web enters the dryer 5.

From the dryer 5, the paper web passes around the roller 49 of the coater 6*b* which is structurally and functionally to the coater 4*b*. It includes a deflecting roller 50 around which the paper web 1 is looped, a slot nozzle 51 for applying liquid resin (free from abrasive particles) to the predreied coating mass, a predosing unit 52 which has an elastic strip of limited stiffness bearing at 53 against the coat and preferably a plastic.strip and an air brush 54. The two last stations of the apparatus, as described in connection with FIGS. 1 and 2, are an applicator 7 and a final dryer.

The apparatus of FIGS. 1–3 can apply cover layers to the highly abrasive coating without significant wear of expensive machine parts by the hard material particles because of the specific construction of the coaters 6, 6*a* and 6*b* which have been described.

Since the problem of wear minimization must also be considered in application of the abrasive containing coating mass, it is understandable that in the embodiments of FIGS. 2 and 3, the first coaters will correspond structurally and functionally with the second coaters. It would however be a mistake to assume that this correspondence between first and second coaters is required or is especially advantageous in individual cases. In practice the choice of coaters will depend upon the particular apparatus and the composition to be applied and, of course, the coaters of one embodiment can be interchanged with those described therein.

We claim:

1. An apparatus for impregnating and coating of paper for use as a cover sheet in a wear-resistant laminate, said apparatus comprising:

means for forming a path for a paper web;

impregnating means along said path for impregnating said paper web with a synthetic resin;

a first coater along said path downstream of said impregnating means for thereafter applying a coating composition containing a liquid resin and a fine-grain abrasive material to one side of the paper web impregnated with said synthetic resin to produce a coated paper;

a dryer along said path downstream of said first coater for thereafter drying the coated paper to form an abrasive layer on said coated paper;

a second coater along said path downstream of said dryer for applying over said abrasive layer on said coated paper a coating of a liquid resin free from abrasive particles; and a further dryer along said path downstream of said second coater for drying said coating on the coated paper web, said second coater including:

a deflecting roller around which said paper web is looped, a metering roller parallel to said deflecting roller and defining a gap therewith at driven at least approximately synchronously with said deflecting roller, a slot nozzle for applying liquid resin to said web on said deflecting roller directly or to said metering roller, and a doctoring element comprising a rectangular flap of flexible elastomeric material affixed at one side along an edge parallel to said rollers and resting slackly on an upper stretch of said web coming off said deflection roller.

2. The apparatus defined in claim 1, further comprising a retaining bar receiving said edge parallel to said rollers, and a vibrator connected to said bar for vibrating same.

3. An apparatus for impregnating and coating of paper for use as a cover sheet in a wear-resistant laminate, said apparatus comprising:

means for forming a path for a paper web;

impregnating means along said path for impregnating said paper web with a synthetic resin;

a first coater along said path downstream of said impregnating means for thereafter applying a coating composition containing a liquid resin and a fine-grain abrasive material to one side of the paper web impregnated with said synthetic resin to produce a coated paper;

a dryer along said path downstream of said first coater for thereafter drying the coated paper to form an abrasive layer on said coated paper;

a second coater along said path downstream of said dryer for applying over said abrasive layer on said coated paper a coating of a liquid resin free from abrasive particles; and a further dryer along said path downstream of said second coater for drying said coating on the coated paper web, said second coater including:

a deflecting roller around which said paper web is looped, a slot nozzle for applying liquid resin to said web on said deflecting roller directly, premetering element comprising an elastic strip of limited stiffness and composed of plastic for controlling an amount of liquid resin applied to said web, and an air brush trained on said web on said deflection roller.

4. The apparatus defined in claim 3, further comprising an applicator between said first coater and said further dryer for applying a liquid resin to an opposite side of said paper web.

5. The apparatus defined in claim 4 wherein said applicator comprises a screen coating roller.

6. The apparatus defined in claim 4 wherein said applicator is between said second coater and said further dryer.

* * * * *